US009070999B2

(12) United States Patent
Endo et al.

(10) Patent No.: US 9,070,999 B2
(45) Date of Patent: Jun. 30, 2015

(54) ELECTRIC CONNECTOR AND TERMINAL USED THEREFOR

(71) Applicant: DAI-ICHI SEIKO CO., LTD., Kyoto (JP)

(72) Inventors: Takayoshi Endo, Shizuoka (JP); Sakai Yagi, Shizuoka (JP); Masaru Senmyou, Shizuoka (JP)

(73) Assignee: DAI-ICHI SEIKO CO., LTD., Kyoto (JP)

( * ) Notice: Subject to any disclaimer, the term of this patent is extended or adjusted under 35 U.S.C. 154(b) by 0 days.

(21) Appl. No.: 14/097,512

(22) Filed: Dec. 5, 2013

(65) Prior Publication Data

US 2014/0170885 A1 Jun. 19, 2014

(30) Foreign Application Priority Data

Dec. 13, 2012 (JP) ..... 2012-272333

(51) Int. Cl.

| | |
|---|---|
| ***H01R 13/506*** | (2006.01) |
| ***H01R 13/193*** | (2006.01) |
| *H01R 13/436* | (2006.01) |
| *H01R 13/50* | (2006.01) |

(52) U.S. Cl.

CPC ..... *H01R 13/506* (2013.01); *H01R 13/4361* (2013.01); *H01R 13/501* (2013.01); *H01R 13/193* (2013.01)

(58) Field of Classification Search

CPC ..... H01R 13/4362; H01R 13/4361; H01R 13/6275; H01R 13/6272; H01R 13/4223; H01R 13/4365

USPC ..... 439/752, 595, 358

See application file for complete search history.

(56) References Cited

U.S. PATENT DOCUMENTS

| | | | | |
|---|---|---|---|---|
| 4,679,874 | A | 7/1987 | Saijo et al. | |
| 5,292,262 | A * | 3/1994 | Endo et al. | 439/752 |
| 5,454,740 | A * | 10/1995 | Sakano et al. | 439/752 |
| 5,460,550 | A * | 10/1995 | Okayasu et al. | 439/752 |
| 5,567,184 | A * | 10/1996 | Sasai et al. | 439/752 |
| 5,716,235 | A * | 2/1998 | Endo et al. | 439/596 |
| 5,803,773 | A * | 9/1998 | Kashiyama et al. | 439/752 |
| 5,827,093 | A * | 10/1998 | Okabe | 439/752 |

(Continued)

FOREIGN PATENT DOCUMENTS

| | | |
|---|---|---|
| EP | 1073153 | 1/2001 |
| EP | 1176670 | 1/2002 |

(Continued)

OTHER PUBLICATIONS

Partial European Search Report issued Mar. 14, 2014 in corresponding European Patent Application No. EP 13 19 6347.

*Primary Examiner* — Gary Paumen

(74) *Attorney, Agent, or Firm* — Wenderoth, Lind & Ponack, L.L.P.

(57) ABSTRACT

An electric connector includes a housing including a groove into which a terminal is inserted, and a first engagement portion engageable to a first engagement section formed at the terminal, a rear holder including a second engagement portion engageable to a second engagement section formed at the terminal, the rear holder being formed integrally with the housing such that the rear holder is rotatable at one end thereof relative to the housing, and a connector system for detachably fixing the housing and the rear holder to each other when the rear holder is rotated onto the housing.

11 Claims, 18 Drawing Sheets

(56) References Cited

U.S. PATENT DOCUMENTS

| | | | | |
|---|---|---|---|---|
| 5,947,775 | A * | 9/1999 | Yamamoto et al. | 439/752 |
| 6,000,967 | A * | 12/1999 | Norizuki et al. | 439/596 |
| 6,027,374 | A * | 2/2000 | Nagai et al. | 439/596 |
| 6,176,740 | B1 * | 1/2001 | Abe et al. | 439/596 |
| 6,328,614 | B1 | 12/2001 | Osawa | |
| 6,482,035 | B2 * | 11/2002 | Okabe et al. | 439/596 |
| 6,604,966 | B1 | 8/2003 | Hayes et al. | |
| 6,695,645 | B2 * | 2/2004 | Takahashi | 439/596 |
| 6,948,986 | B2 | 9/2005 | Kojima et al. | |
| 7,056,142 | B2 * | 6/2006 | Ueda | 439/358 |
| 7,104,829 | B2 * | 9/2006 | Volpone et al. | 439/358 |
| 7,214,090 | B2 * | 5/2007 | Aihara et al. | 439/475 |
| 7,285,004 | B1 * | 10/2007 | Fukuda et al. | 439/358 |
| 7,503,793 | B2 * | 3/2009 | Morello | 439/352 |
| 7,575,464 | B2 * | 8/2009 | Kobayashi et al. | 439/358 |
| 7,695,315 | B2 * | 4/2010 | Hitchcock et al. | 439/541.5 |
| 8,721,357 | B2 * | 5/2014 | Li et al. | 439/358 |
| 8,747,169 | B2 | 6/2014 | Ito | |
| 2002/0002002 | A1 | 1/2002 | Okabe et al. | |
| 2002/0119693 | A1 * | 8/2002 | Chen | 439/358 |
| 2004/0132351 | A1 | 7/2004 | Miyakawa et al. | |
| 2004/0235365 | A1 | 11/2004 | Fujita | |
| 2005/0130483 | A1 * | 6/2005 | Ishiyama | 439/358 |
| 2006/0166545 | A1 * | 7/2006 | Tanaka et al. | 439/358 |
| 2006/0223356 | A1 * | 10/2006 | Zhang et al. | 439/358 |
| 2009/0269963 | A1 | 10/2009 | Brown et al. | |

FOREIGN PATENT DOCUMENTS

| | | |
|---|---|---|
| EP | 2530788 | 12/2012 |
| JP | 7-211380 | 8/1995 |
| JP | 08-255646 | 10/1996 |
| JP | 2001-006790 | 1/2001 |
| JP | 2005-019282 | 1/2005 |
| JP | 2006-511918 | 4/2006 |
| JP | 2011-222157 | 11/2011 |

* cited by examiner

ELECTRIC CONNECTOR AND TERMINAL USED THEREFOR

CROSS-REFERENCE TO RELATED APPLICATIONS

The entire disclosure of Japanese Patent Application No. 2012-272333 filed on Dec. 13, 2012 including the specification, claims, drawings and summary is incorporated herein by reference in its entirety.

BACKGROUND OF THE INVENTION

1. Field of the Invention

The invention relates to an electric connector used for a wire harness for electrically connecting a circuit board thereto, and further relates to a metal terminal used in the connector.

2. Description of the Related Art

There have been suggested electric connectors having a variety of structures and/or functions for electrically connecting a circuit board to a wire harness. In order to enhance a force by which a terminal is held in a connector housing, there has been known a system for doubly engaging the terminal to the housing.

For instance, Japanese Patent Application Publication No. H07(1995)-211380 has suggested an electric connector. FIGS. 16 to 18 are cross-sectional views of the electric connector suggested in the above-mentioned Publication, and FIG. 19 is a vertical cross-sectional view of the electric connector.

The illustrated connector includes a connector housing 1, and a rear holder 6. A plurality of terminal rooms 3 are formed in the connector housing 1. Each of the terminal rooms 3 is formed with a lance 5 for preventing terminal 4 inserted into the terminal room 3 from being slipped out of the terminal room 3.

As illustrated in FIGS. 16 to 19, the rear holder 6 includes a main plate 8, and a pair of engagement walls 7 downwardly extending from the main plate 8. As illustrated in FIG. 19, projections 9*a* and 9*b* are formed at inner surfaces of the engagement walls 7. The projections 9*a* and 9*b* sandwich an outer wall of the connector housing 1, thereby the rear holder 6 being temporarily engaged to the connector housing 1 making the engagement walls 7 of the rear holder 6 not to extend into a space in which the terminal 4 is inserted.

In the above-mentioned conventional electric connector, the terminal 4 inserted into the terminal room 3 formed in the connector housing 1 is temporarily doubly fixed in the terminal room 3 by the rear holder 6 and the lance 5. However, since the system for temporarily fixing the rear holder 6 to the connector housing 1 is located above the connector housing 1, it is quite difficult or almost impossible to reduce a height of the electric connector.

SUMMARY OF THE INVENTION

In view of the above-mentioned problems in the conventional electric connector, it is an object of the present invention to provide an electric connector capable of being readily assembled and making it possible to design a connector to have a reduced height, and to provide a terminal capable of providing an intensive force at which the terminal holds another terminal, and presenting enhanced contact reliability.

In one aspect of the present invention, there is provided an electric connector including a housing including a groove into which a terminal is inserted, and a first engagement portion engageable to a first engagement section formed at the terminal, a rear holder including a second engagement portion engageable to a second engagement section formed at the terminal, the rear holder being formed integral with the housing such that the rear holder is rotatable at one end thereof relative to the housing, and a connector system for detachably fixing the housing and the rear holder to each other when the rear holder rotates onto the housing.

In accordance with the above-mentioned electric connector, the connector system connects the housing and the rear holder to each other by rotating the rear holder onto the housing after inserting the terminal into the groove of the housing. Thus, the electric connector can be readily assembled, and the electric connector can be designed to have a reduced height. Furthermore, since the first and second engagement sections of the terminal inserted into the groove are engaged with the first engagement portion of the housing and the second engagement portion of the rear holder, respectively, that is, since the terminal is doubly engaged with the housing and the rear holder, the terminal can be stably held relative to the housing and the rear holder.

In another aspect of the present invention, there is provided an electric connector including a housing including a groove into which a terminal is inserted, a lock arm formed at the housing such that the lock arm is able to substantially vertically move relative to the housing in order to detachably engage to a male housing to which the housing is connected, and a lock guard preventing the lock arm from being deformed in a direction in which the lock arm stands, the lock arm having a surface at which the lock arm is pushed, the surface being substantially on a level with an uppermost surface of the lock guard or lower than the uppermost surface of the lock guard.

The electric connector in accordance with the above-mentioned present invention makes it possible to design the electric connector to have a reduced height, and to prevent the lock arm from being damaged.

In still another aspect of the present invention, there is provided an electric connector including a housing including a groove into which a terminal is inserted, and a first engagement portion engageable to a first engagement section formed at the terminal, and a rear holder including a second engagement portion engageable to a second engagement section formed at the terminal, the rear holder being formed integral with the housing such that the rear holder is rotatable at one end thereof relative to the housing, the rear holder being formed at a front thereof with a recess into which a projection formed at a rear of the second engagement section of the terminal is fittable.

The electric connector in accordance with the above-mentioned present invention makes it possible to design an area at which the second engagement section of the terminal and a front of the rear holder make contact with each other, to be broad, ensuring to enhance a force by which the terminal is held relative to the housing.

It is preferable that the rear holder forms an obtuse angle relative to the housing before the rear holder starts rotating relative to the housing.

By so designing, the rear holder does not interfere with the terminal when the terminal is inserted into the groove of the housing, ensuring enhancement of an efficiency of assembling the electric connector.

It is preferable that the connector system includes a first projection formed at a partition wall defining the groove of the housing, and a first recess formed at the rear holder to receive the first projection thereinto.

By so designing, it is possible to design the electric connector to have a reduced height, and to firmly hold the terminal in the housing.

It is preferable that the connector system includes a second projection formed at a side of the rear holder, and a second recess formed at the housing to receive the second projection thereinto.

By so designing, it is possible to delete a play between the rear holder and the housing when they are coupled to each other, ensuring that the rear holder can be surely coupled to the housing.

It is preferable that the second recess comprises an opening formed at a flexible upright wall of the housing such that the second projection is insertable into the opening.

By so designing, when an external force attempting to separate the housing and the rear holder away from each other exerts on them after they are coupled to each other, it is possible to prevent the opening of the upright wall, acting as the second recess, from being damaged.

It is preferable that the connector system includes a third projection formed at a front of the rear holder, and a third recess formed at the housing to receive the third projection thereinto.

By so designing, it is possible to prevent the rear holder from floating from the housing after they are coupled to each other.

It is preferable that the electric connector further includes a stopper formed at the first recess of the rear holder, the stopper making contact with the first projection to prevent the terminal from slipping out of the groove when an external force exerts on the terminal in a direction opposite to a direction in which the terminal is inserted into the groove.

By so designing, it is possible to prevent the terminal from slipping out of the groove when an external force (a tensile force) exerts on the terminal in a direction opposite to a direction in which the terminal is inserted into the groove after the electric connector has been assembled. It is preferable that the stopper is convex at a top thereof in an obtuse angle, ensuring it possible to prevent the stopper from being collapsed when a compressive force exerts thereon.

In yet another aspect of the present invention, there is provided a terminal adapted to be inserted into a groove formed at a housing, the housing cooperating with a rear holder to be connected to the housing to define an electric connector, the terminal including a first engagement section engageable to a first engagement portion of the housing, and a second engagement section engageable to a second engagement portion of the rear holder, the first engagement section having a projection projecting towards an axis of the terminal such that a ceiling of the terminal makes contact with the projection when a second terminal inserted into the terminal upwardly pushes the ceiling.

In accordance with the above-mentioned invention, it is possible to surely compress another terminal inserted into the terminal, ensuring that the another terminal can be held with an intensive force, and contact reliability can be enhanced.

It is preferable that the second engagement section is formed at a rear with a projection fittable into a recess formed at a front of the rear holder.

By so designing, it is possible to design an area at which the second engagement section of the terminal and a front of the rear holder make contact with each other, to be broad, ensuring to enhance a force by which the terminal is held relative to the housing.

The advantages obtained by the aforementioned present invention will be described hereinbelow.

The present invention provides an electric connector capable of being readily assembled and having a reduced height, and further provides a terminal capable of providing an intensive force at which the terminal holds another terminal, and presenting enhanced contact reliability between the terminal and the another terminal.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENT

A preferred embodiment in accordance with the present invention will be explained hereinbelow with reference to drawings.

Figure 1:
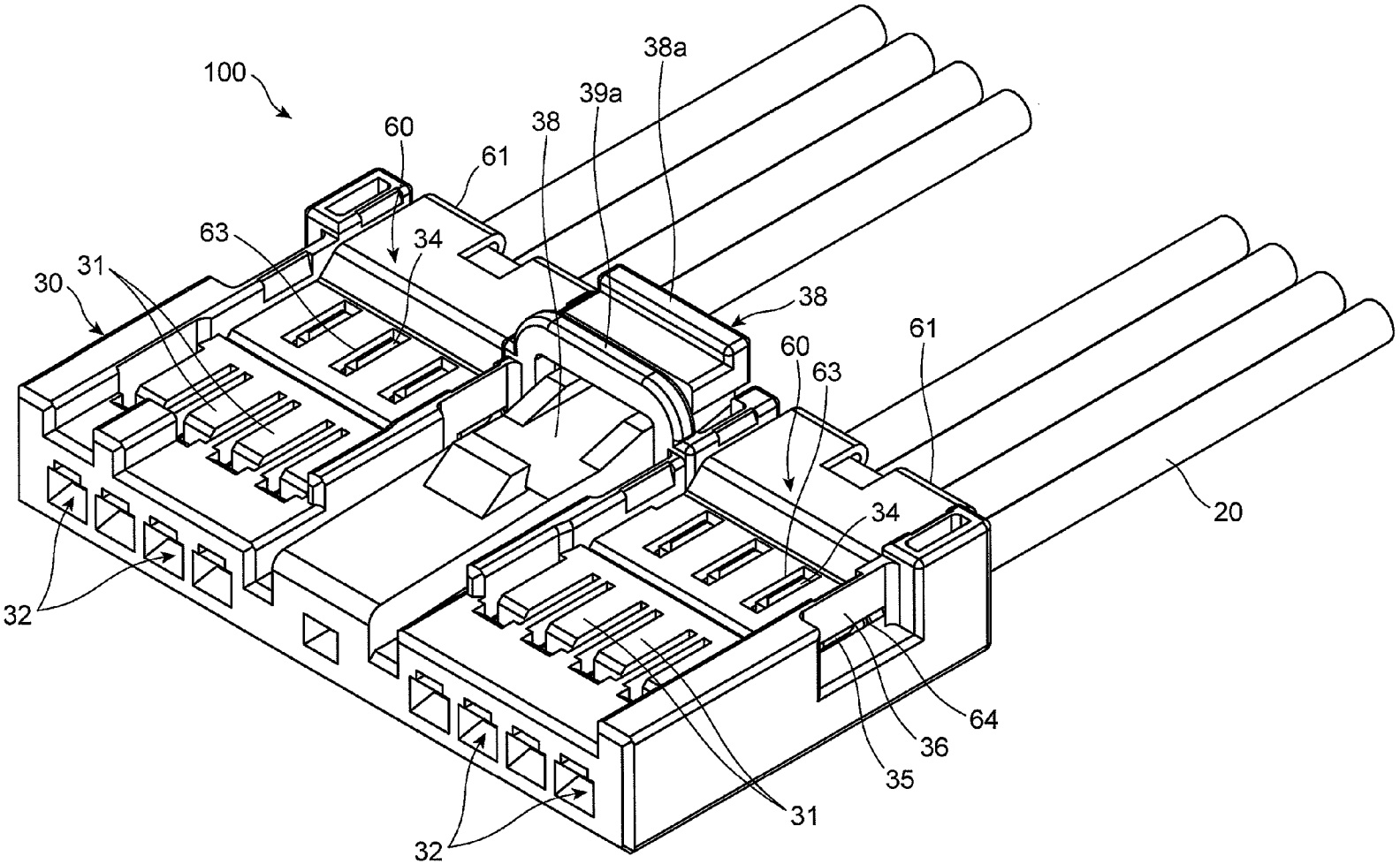
FIG. 1 is a perspective view of the electric connector in accordance with the embodiment of the present invention.
Figure 2:
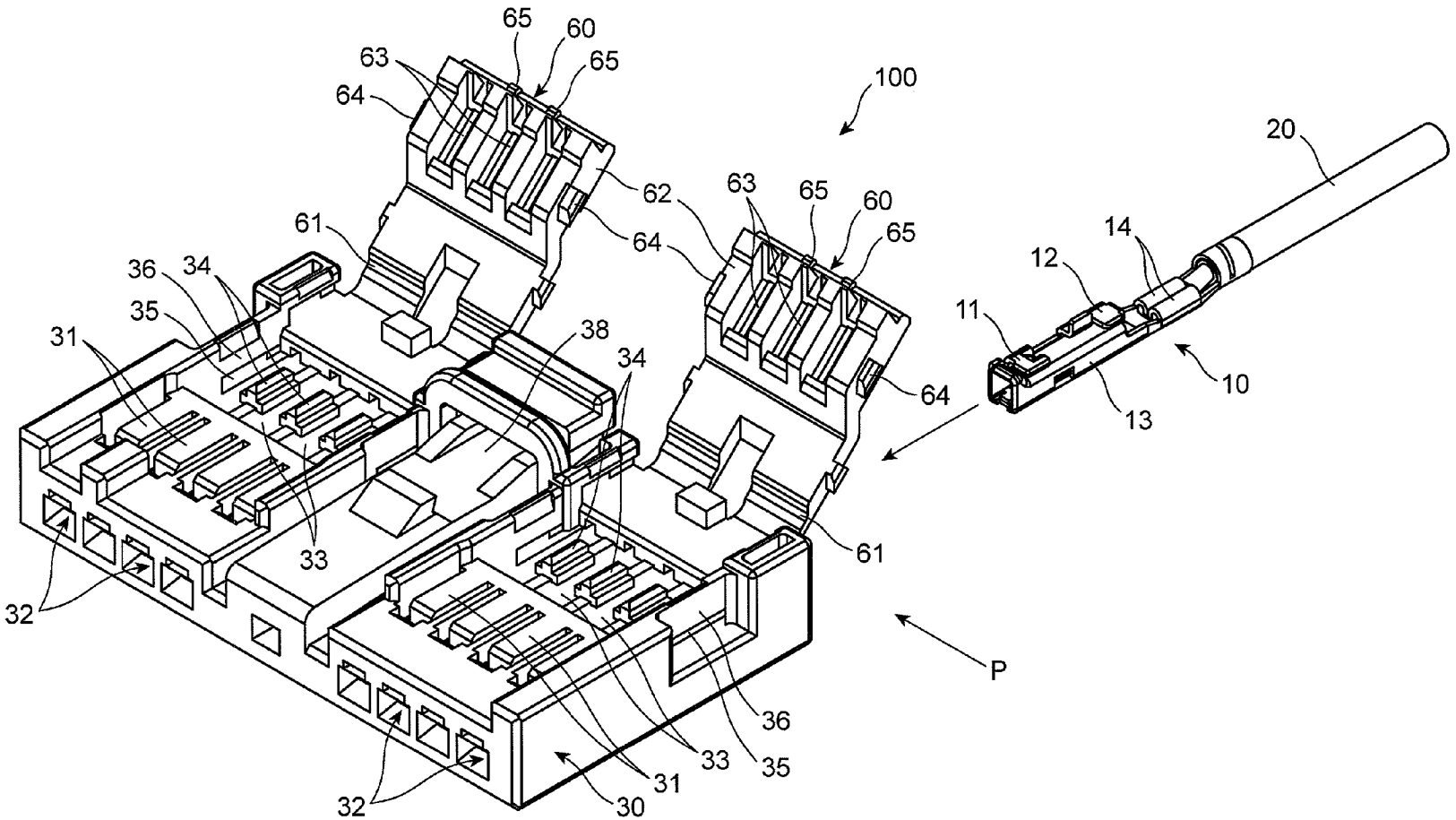
FIG. 2 is an exploded perspective view of the electric connector illustrated in FIG. 1.
Figure 3:
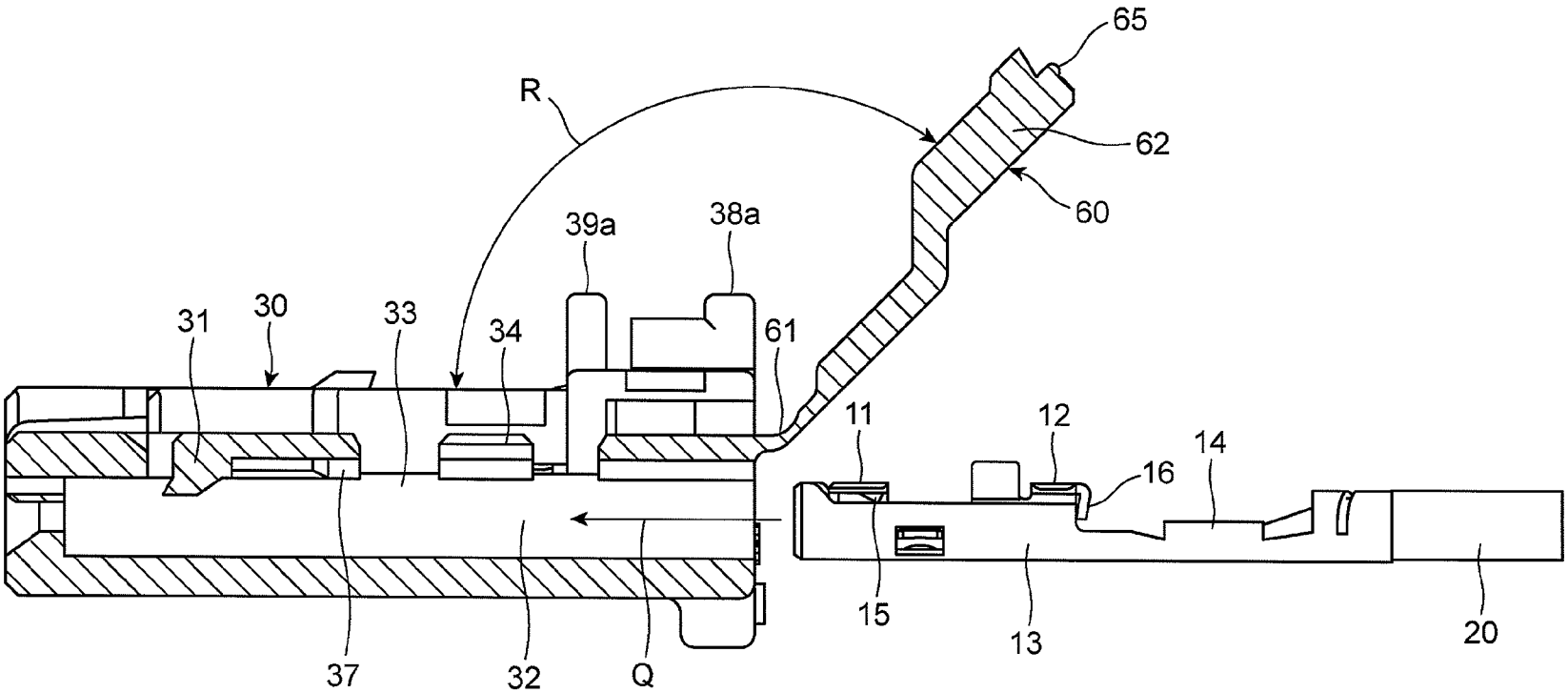
FIG. 3 is a side view seen in a direction of the arrow P shown in FIG. 2, with parts of the electric connector being omitted.

As illustrated in FIGS. 1 to 3, the electric connector 100 in accordance with the embodiment includes a housing 30, a rear holder 60, and a plurality of first to third connector systems.

The housing 30 is formed with a plurality of grooves 32 into each of which a terminal 10 composed of a metal is inserted, and includes a first engagement portion 31 to be engaged to a first engagement section 11 of the terminal 10 inserted into the groove 32 for preventing the terminal 10 from slipping out of the groove 32.

The rear holder 60 is formed integral with the housing 30 through a hinge portion 61, and includes a second engagement portion 62 to be engaged to a second engagement section 12 of the terminal 10 inserted into the groove 32 for preventing the terminal 10 from slipping out of the groove 32.

Each of the first to third connector systems join the rear holder 60 and the housing 30 to each other when the rear holder 60 rotates about the hinge portion 61 onto the housing 30.

Figure 4:
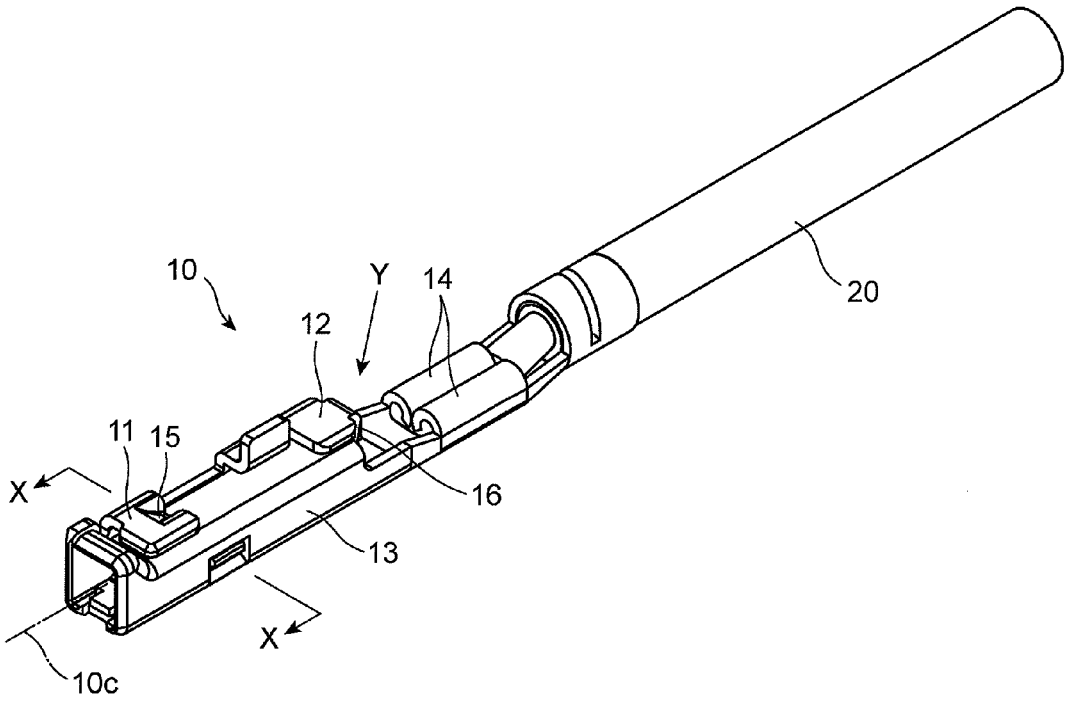
FIG. 4 is a perspective view of the terminal to be inserted into the electric connector illustrated in FIG. 2.

As illustrated in FIG. 4, the terminal 10 includes a contact 13 having a substantially square cross-section such that another terminal can be inserted thereinto, and a compression section 14 formed at a proximal end of the contact 13 for connecting an electric cable 20 thereto. The contact 13 is formed on an upper surface at a distal end thereof with a first engagement section 11 upwardly extending and having a substantially rectangular cross-section, and further, on an upper surface at a proximal end thereof with a second engagement section 12 upwardly extending and having a substantially rectangular cross-section. The terminal 10 can be formed by pressing and bending a plate composed of a metal having electrical conductivity.

As illustrated in FIGS. 2 and 3, an angle R formed between the housing 30 and the rear holder 60 is an obtuse angle before the rear holder 60 is rotated about the hinge portion 61 onto the housing 30 (that is, after the housing 30, the hinge portion 61 and the rear holder 60 are formed). In the embodiment, the angle R is set equal to about 135 degrees, but is not to be limited to 135 degrees.

Figure 5:
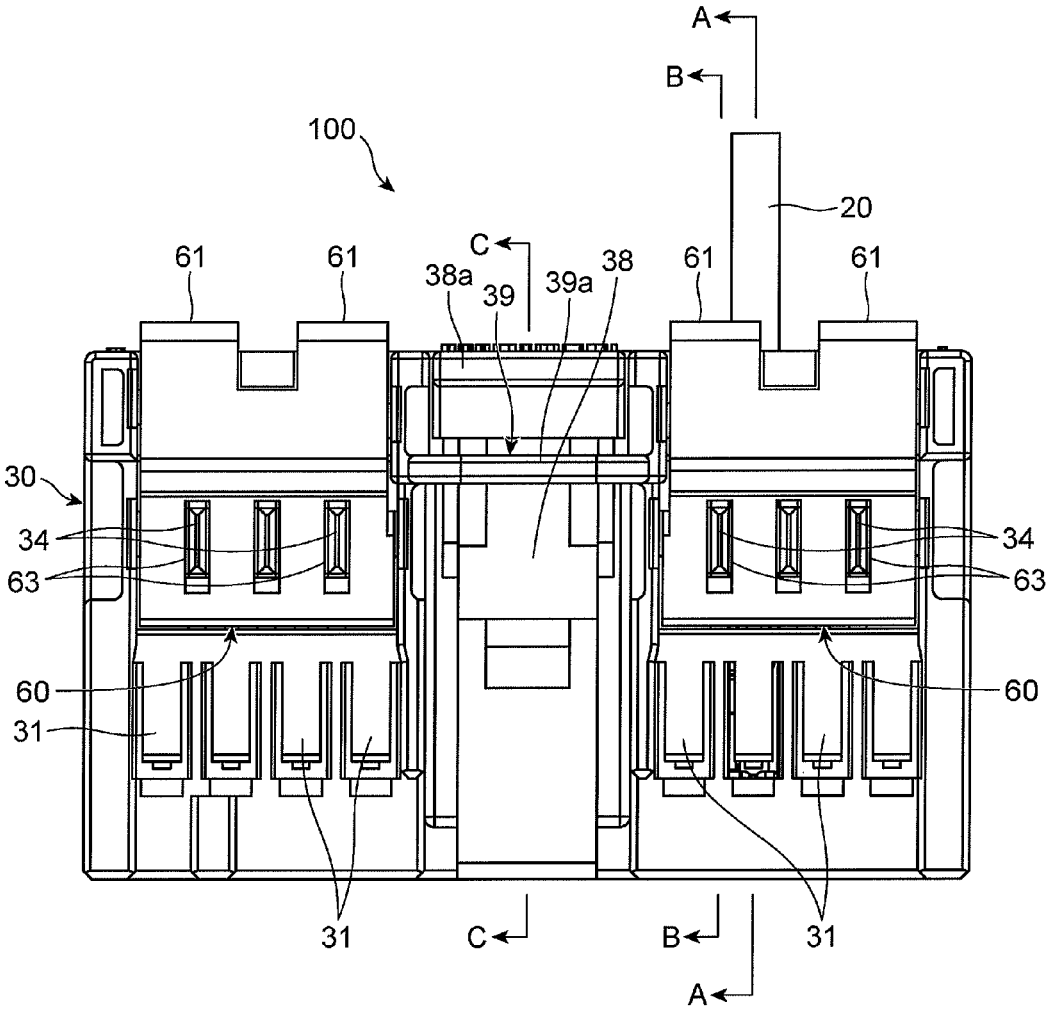
FIG. 5 is a plan view of the electric connector illustrated in FIG. 1.
Figure 6:
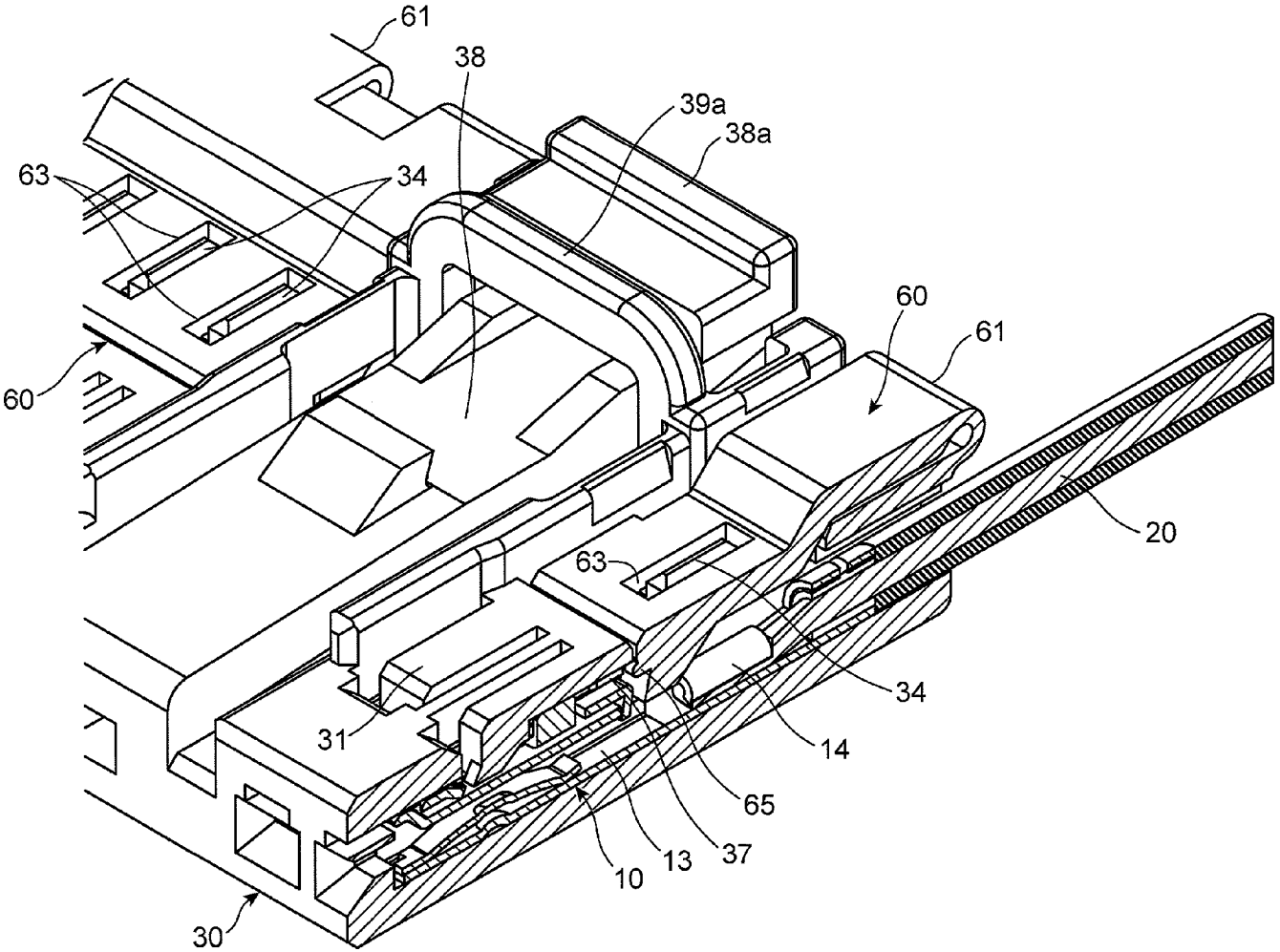
FIG. 6 is a perspective cross-sectional view taken along the lien A-A shown in FIG. 5, with parts of the electric connector being omitted.

As illustrated in FIGS. 2, 5 and 6, the first connector system is comprised of a first projection 34 formed on an upper surface of a partition wall 33 defining the groove 32 in the housing 30, and an opening 63, acting as a first recess, formed at the rear holder 60 to receive the first projection 34 thereinto. As later mentioned, rotating the rear holder 60 about the hinge portion 61 onto the housing 30 and then compressing the rear holder 60 towards the housing 30, the first projection 34 of the housing 30 is inserted into the opening 63 of the rear holder 60, and accordingly, the rear holder 60 and the housing 30 are joined to each other in such a condition that they overlap on each other. Thus, the electric connector 100 can have a reduced height, and the terminal 10 can be firmly held into the groove 32.

Figure 9:
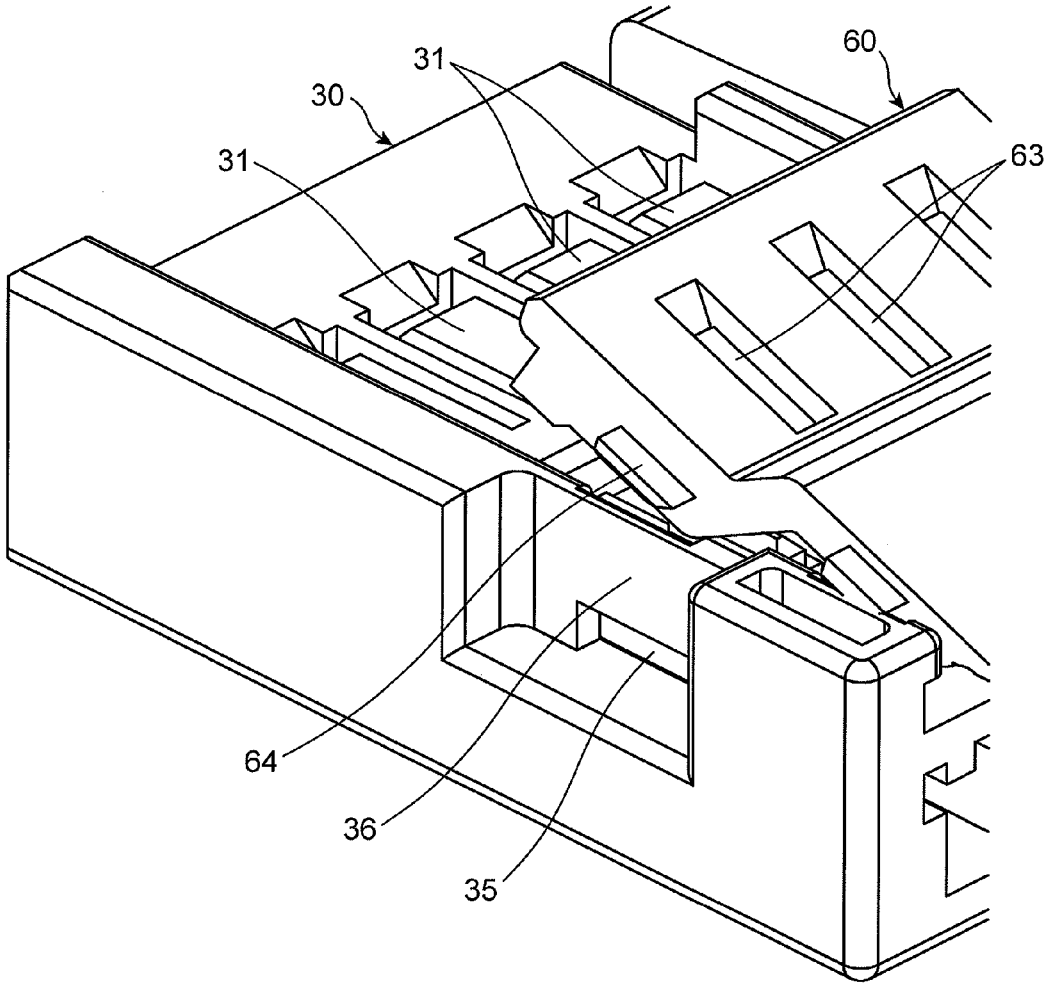
FIG. 9 is a perspective view of the electric connector illustrated in FIG. 1 which is being assembled, seen in an oblique and backward direction, with parts thereof being omitted.
Figure 10:
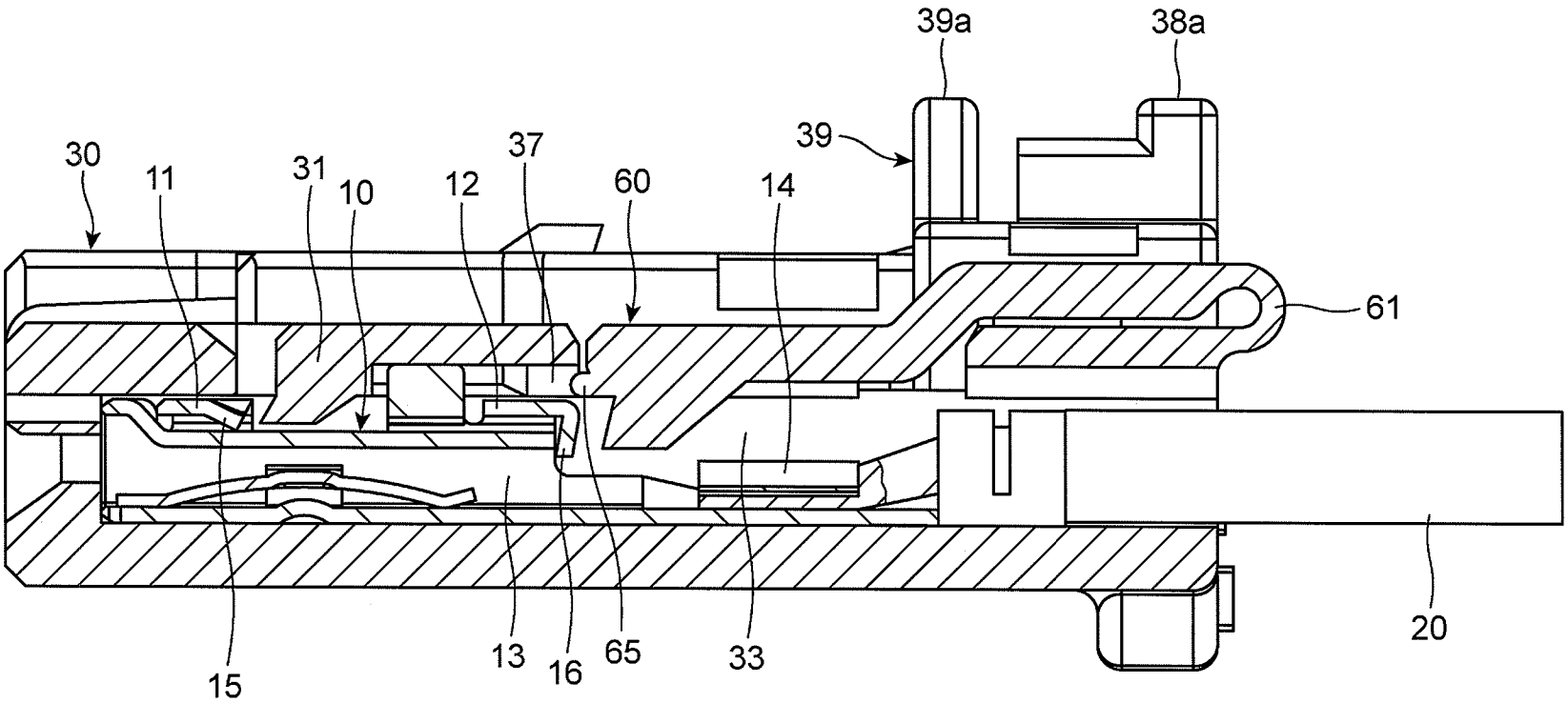
FIG. 10 is a cross-sectional view taken along the line A-A shown in FIG. 5.

As illustrated in FIGS. 2 and 9, the second connector system is comprised of a second projection 64 formed at a side of the rear holder 60, and a one-leg gate type opening 35, acting as a second recess, formed at the housing 30 to receive the second projection 64 thereinto. The opening 35 is open at a flexible upright wall 36 formed at the housing 30 such that the second projection 64 can be inserted thereinto. As later mentioned, rotating the rear holder 60 about the hinge portion 61 onto the housing 30 and then compressing the rear holder 60 towards the housing 30, the second projection 64 slides on an inner surface of the upright wall 36, and thus, the upright wall 36 is deformed in the vicinity of the opening 35 to extend in a lateral direction of the housing 30, and then, the second projection 64 is inserted into the opening 35. Thus, the rear holder 60 is surely engaged to the housing 30 without a play therebetween. Furthermore, after the rear holder 60 was engaged to the housing 30, even if an external force exerts on the rear holder 60 and/or the housing 30 to separate them away from each other, it is possible to avoid the opening 35 from being broken.

Furthermore, as illustrated in FIGS. 3 and 6, the third connector system is comprised of a third projection 65 formed at a front of the rear holder 60, and a third recess 37 formed at the rear of and below the first engagement portion 31 of the housing 30 to receive the third projection 65 thereinto. As later mentioned, rotating the rear holder 60 about the hinge portion 61 onto the housing 30 and then compressing the rear holder 60 towards the housing 30, the third projection 65 of the rear holder 60 is fit into the third recess 37 of the housing 30, ensuring that the rear holder 60 is surely engaged to the housing 30 without a play therebetween, and further without floating of the rear holder 60.

Figure 7:
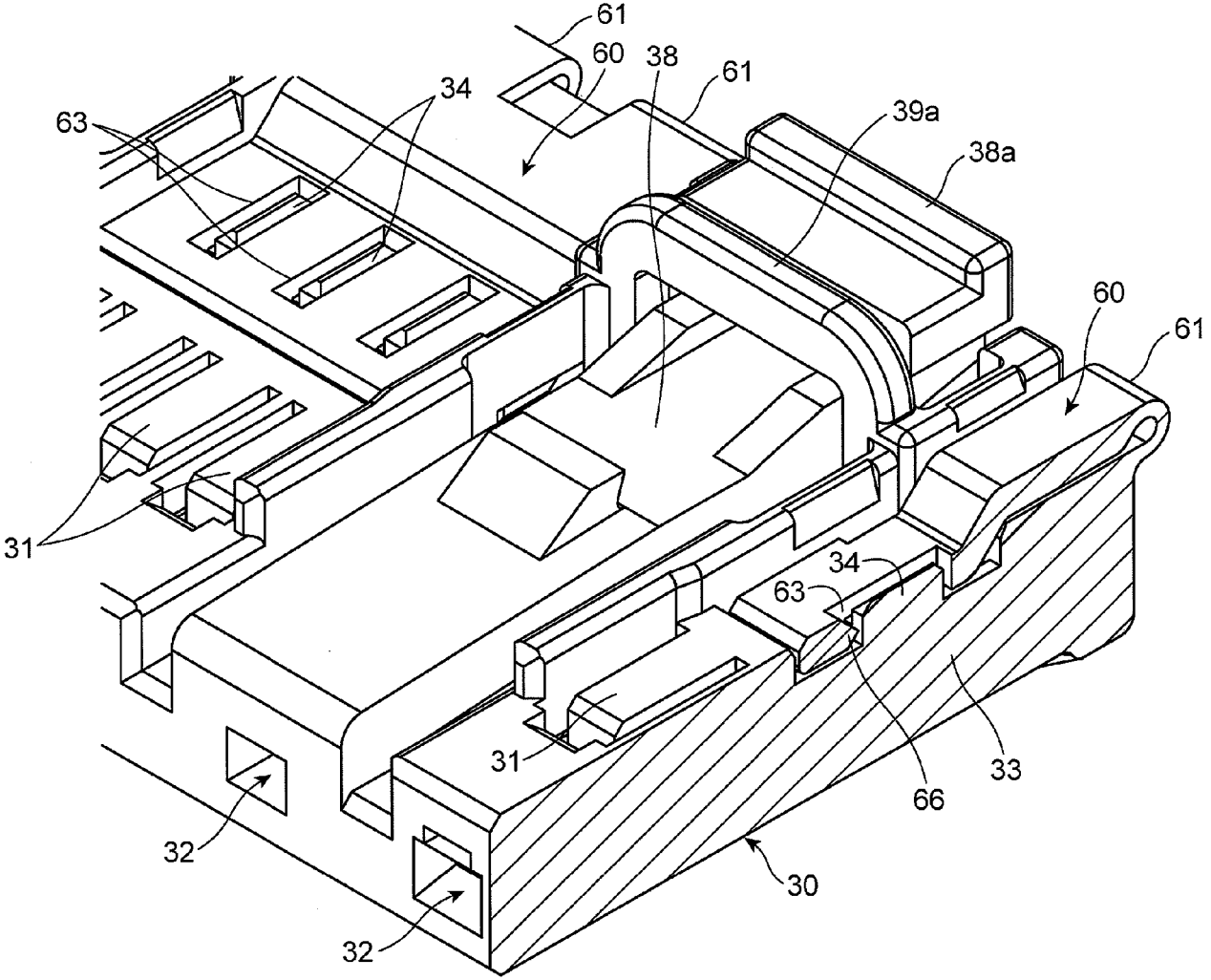
FIG. 7 is a perspective cross-sectional view taken along the lien A-A shown in FIG. 6, with parts of the electric connector being omitted.
Figure 8:
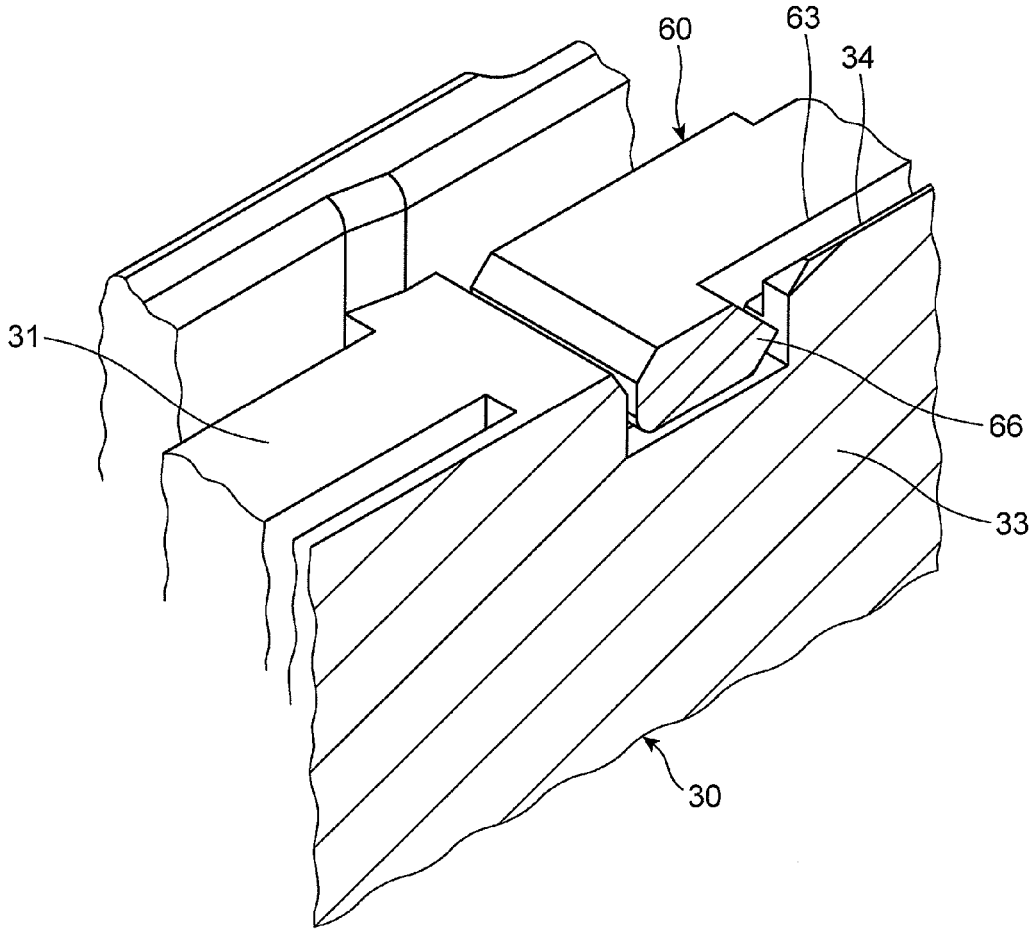
FIG. 8 is an enlarged view of a part of FIG. 7.

As illustrated in FIGS. 6 to 8, the rear holder 60 includes a stopper 66 on an inner surface of a front of the opening 63. The stopper 66 makes contact with the first projection 34 of the partition wall 33 to prevent the terminal 10 from slipping out of the groove 32 when an external force exerts on the terminal 10 in a direction opposite to a direction (the direction indicated with the arrow Q in FIG. 3) in which the terminal 10 is inserted into the groove 32. As illustrated in FIG. 8, the stopper 66 has a vertical triangular cross-section projecting towards the first projection 34. The stopper 66 has an apex angle equal to or greater than 90 degrees, but the apex angle is not to be limited to 90 degrees. Herein, "a front" of the opening 63 in the rear holder 60 indicates a head in a direction (the direction indicated with the arrow Q in FIG. 3) in which the terminal 10 is inserted into the groove 32 after the rear holder 60 is joined onto the housing 30. An opposite side by 180 degrees is called "a rear".

As illustrated in FIGS. 4, 10, 11 and 12, the terminal 10 is formed at a rear of the first engagement section 11 with a projection 15 convex towards an axis 10*c* of the terminal 10. When another terminal 50 is inserted into the contact 13 of the terminal 10 and thereby a ceiling 17 of the contact 13 is upwardly pushed by the another terminal 50, the projection 15 makes contact with the ceiling 17. Accordingly, as mentioned later, the contact 13 of the terminal 10 can surely have electrical contact with the another terminal 50 inserted into the contact 13.

As illustrated in FIGS. 1, 4, 13 and 14, the rear holder 60 is formed with a recess 67 at a front (a head in a direction (the direction indicated with the arrow Q in FIG. 3) in which the terminal 10 is inserted into the groove 32) of the rear holder 60 in a condition that the rear holder 60 is joined to the housing 30. A projection 16 formed at a rear of the second engagement section 12 of the terminal 10 is fittable into the recess 67. Accordingly, by fitting the projection 16 of the terminal 10 inserted into the groove 32 into the recess 67 of the rear holder 60, an area at which the terminal 10 and the rear holder 60 make contact with each other can be broad, ensuring enhancement of a force by which the terminal 10 is held in the housing 30.

The projection 16 can be formed by perpendicularly bending a tongue, formed at a rear of a metal plate defining the second engagement section 12 of the terminal 10, towards the axis 10*c*. However, a method of forming the projection is not to be limited to this one.

Figure 15:
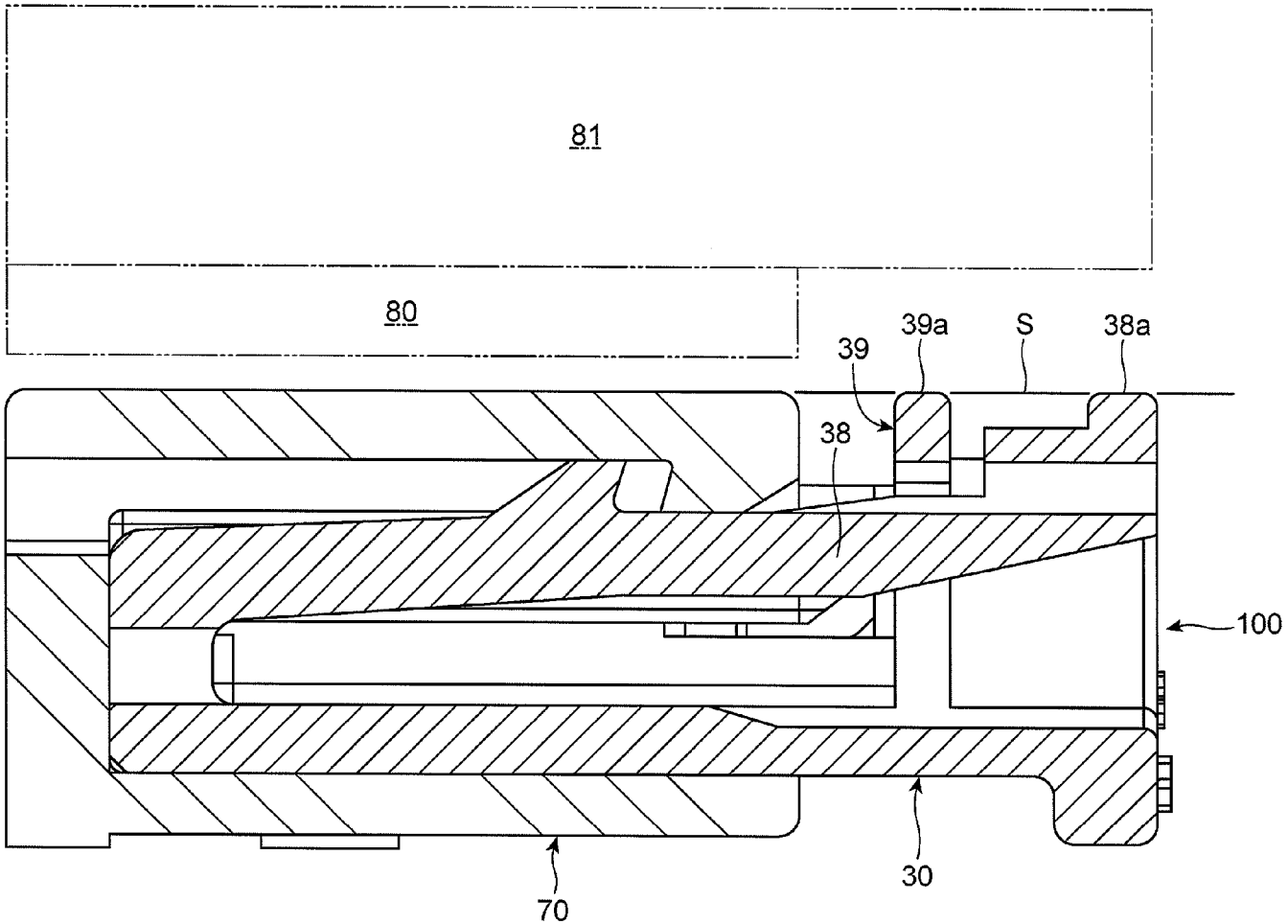
FIG. 15 is a cross-sectional view taken along the line C-C shown in FIG. 5.
Figure 16:
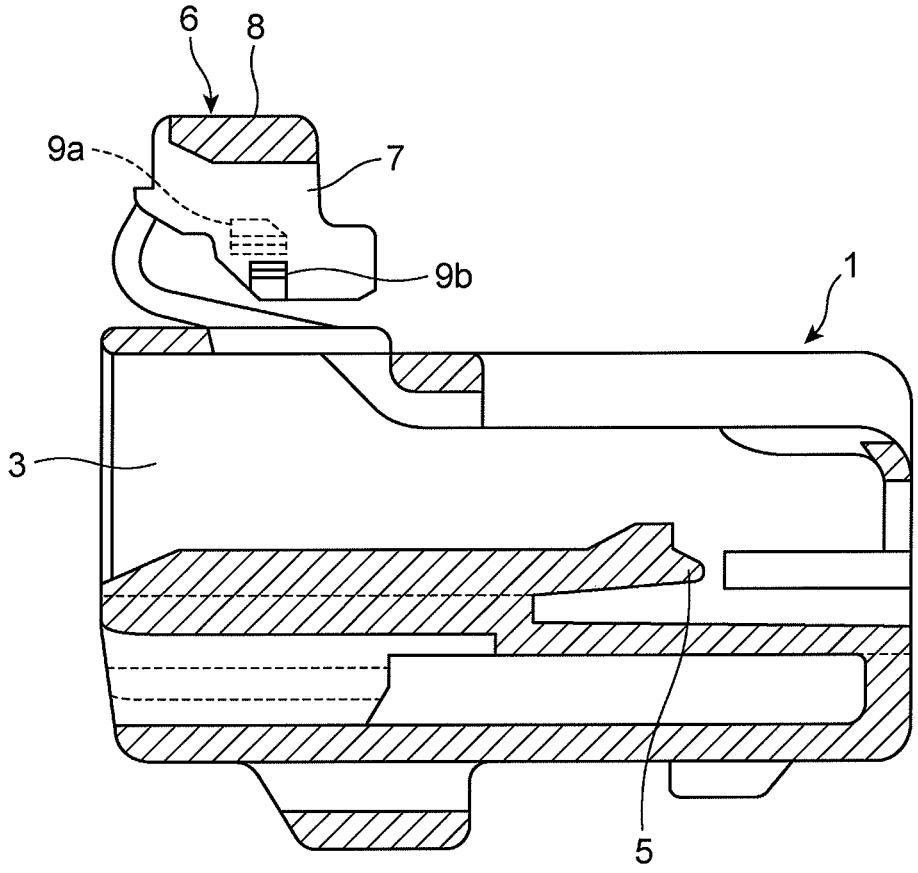
FIG. 16 is a cross-sectional view of the conventional electric connector.
Figure 17:
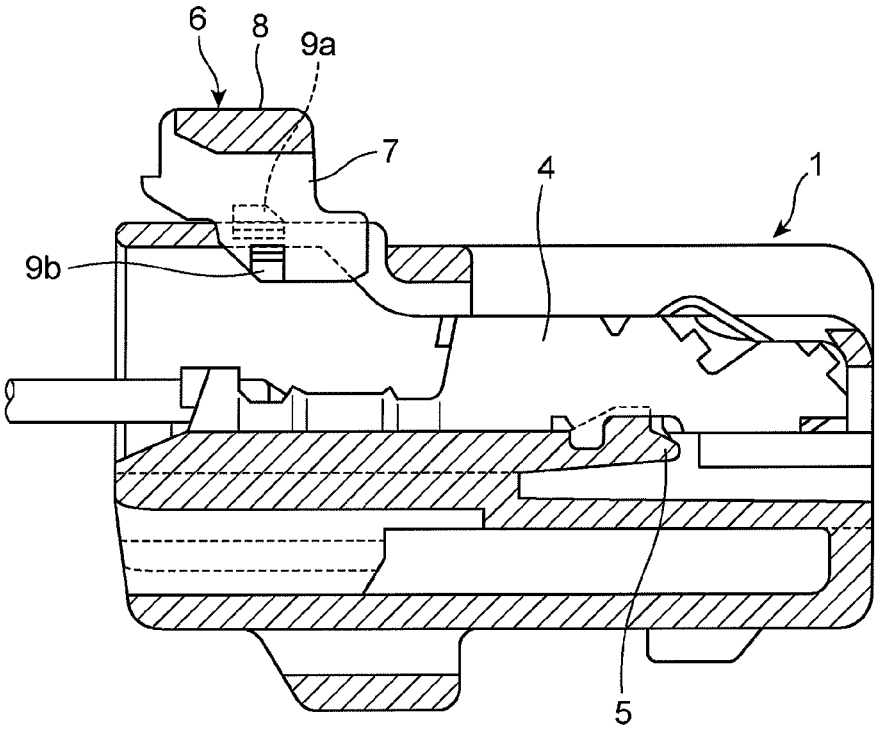
FIG. 17 is a cross-sectional view of the conventional electric connector.
Figure 18:
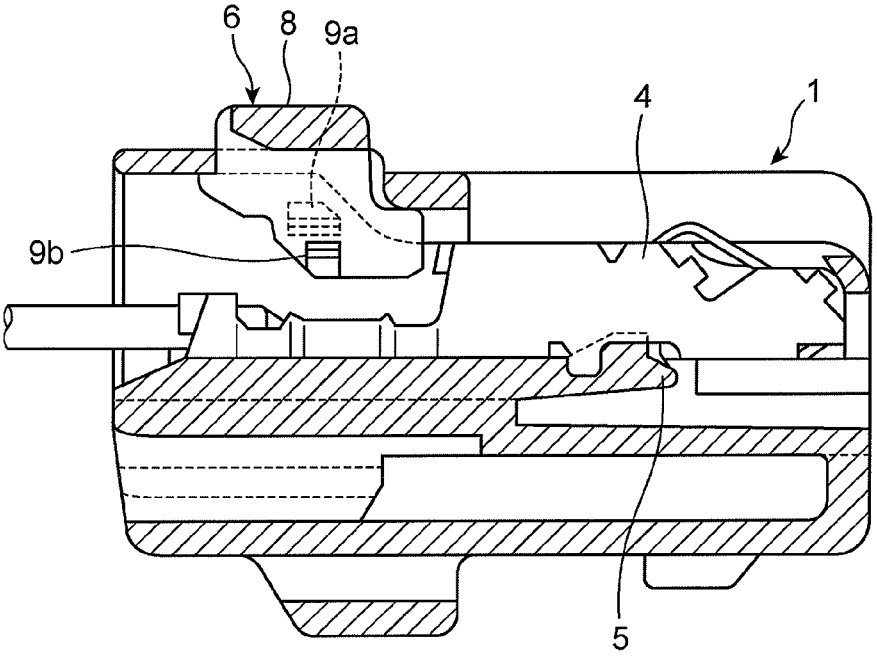
FIG. 18 is a cross-sectional view of the conventional electric connector.
Figure 19:
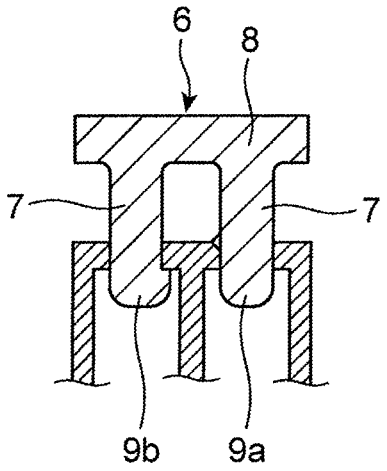
FIG. 19 is a vertical cross-sectional view of the conventional electric connector.

As illustrated in FIG. 15, the housing 30 is formed at an upper surface thereof with a lock arm 38 in order for the housing 30 to be detachably engaged to a male housing 70 which is a part of the electric connector 100. The lock arm 38 is elastic so as to be able to substantially vertically move. A gate-shaped lock guard 39 prevents the lock arm 38 from being deformed in a direction in which the lock arm 38 stands. A surface 38*a* of the lock arm 38 through which the lock arm 38 is pushed is substantially on a level S with an uppermost surface 39*a* of the lock guard 39. The surface 38*a* and the uppermost surface 39*a* are not limited to be on a same level with each other. As an alternative, the surface 38*a* may be designed lower than the uppermost surface 39*a*.

As illustrated in FIGS. 2 and 3, the rear holder 60 and the housing 30 are joined to each other by means of the above-mentioned first to third connector systems by rotating the rear holder 60 onto the housing 30 after the terminal 10 was inserted into the groove 32 of the housing 30. Thus, the electric connector illustrated in FIG. 1 can be readily assembled, and can have a reduced height.

Furthermore, as illustrated in FIG. 3, since the rear holder 60 inclining above and at a rear of the housing 30 forms an obtuse angle together with the housing 30 about the hinge portion 61 before the rear holder 60 is rotated about the hinge portion 61, the rear holder 60 does not interfere with the terminal 10 when the terminal 10 is inserted into the groove 32 through a rear of the housing 30, ensuring enhancement of an efficiency of assembling the electric connector 100.

Since the first and second engagement sections 11 and 12 of the terminal 10 inserted into the groove 32 are engaged with the first engagement portion 31 of the housing 30 and the second engagement portion 62 of the rear holder 60, respectively, that is, since the terminal 10 is doubly engaged with the housing 30 and the rear holder 60, the terminal 10 can be stably held in the housing 30.

The first connector system including the first projection 34 formed at the partition wall 33 of the housing 30 and the opening 63, as the first recess, formed at the rear holder 60 makes it possible for the electric connector 100 to have a reduced height, and for the terminal 10 to be firmly held in the housing 30.

The second connector system including the second projection 64 formed at a side of the rear holder 60 and the opening 35, as the second recess, formed at the upright wall 36 of the housing 30 makes it possible to join the rear holder 60 and the housing 30 to each other without a play, and to surely join the rear holder 60 to the housing 30. Since the upright wall 36 has elastic flexibility, the upright wall 36 provides an advantage that the opening 35 of the upright wall 36 is difficult to be broken when an external force attempting the rear holder 60 and the housing 30 to separate them away from each other exerts on them after they are joined to each other.

The third connector system including the third projection 65 formed at a front of the rear holder 60 and the third recess 37 formed below and at a rear of the housing 30 makes it possible to prevent the rear holder 60 joined to the housing 30 from floating from the housing 30.

The stopper 66 formed in the opening 63 of the rear holder 60 prevents the terminal 10 from slipping out of the groove 32 even when an external force (a tensile force) exerts on the terminal 10 in a direction opposite to a direction in which the terminal 10 is inserted into the groove 32. Furthermore, since the angle of the top of the stopper 66 is an obtuse angle, it is possible to prevent the stopper 66 from being collapsed when a compressive force exerts on the stopper 66.

Figure 11:
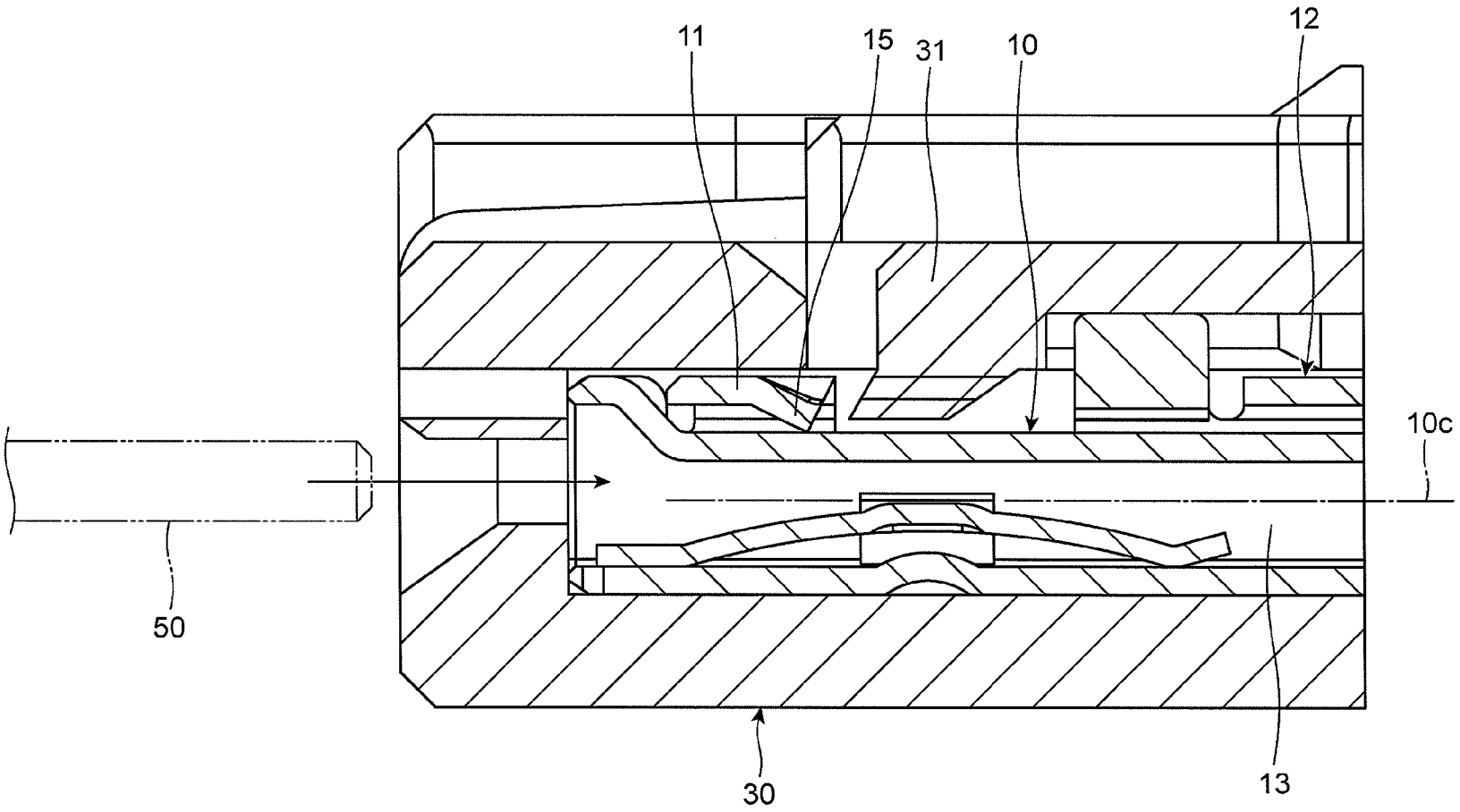
FIG. 11 is an enlarged view of a part of FIG. 10.
Figure 12:
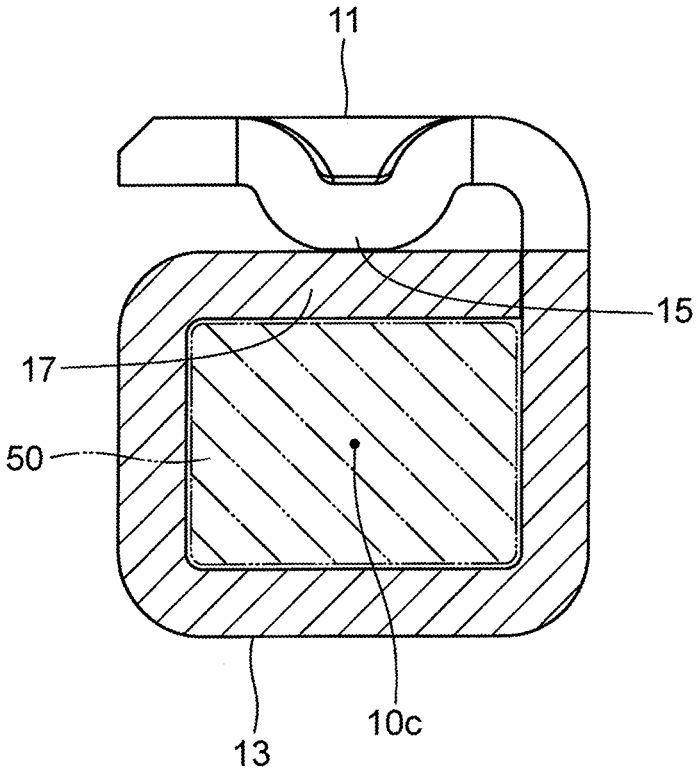
FIG. 12 is a cross-sectional view taken along the line X-X shown in FIG. 4 with parts of the electric connector being omitted.

As illustrated in FIGS. 11 and 12, the first engagement section 11 of the terminal 10 includes the projection 15 projecting towards the axis 10*c* of the terminal 10, and the projection 15 is located so as to be able to make contact with the ceiling 17 situated therebelow (situated close to the axis 10*c*). Accordingly, when another terminal 50 is inserted into the contact 13 of the terminal 10 to thereby cause the ceiling 17 to be pushed up, the projection 15 makes contact with the ceiling 17 to thereby prevent the ceiling 17 from floating. Thus, the another terminal 50 is ensured to make compressive contact with the contact 13, ensuring that a force for holding the another terminal 50 in the contact 13 can be enhanced, and electrical connection between the another terminal 50 and the contact 13 can be accomplished. Furthermore, the projection 15 ensures a broad contact area in which a rear of the first engagement section 11 of the terminal 10 makes contact with a front of the first engagement portion 31 of the housing 30, resulting in enhancement in a force for holding the terminal 10 in the housing 30.

Figure 13:
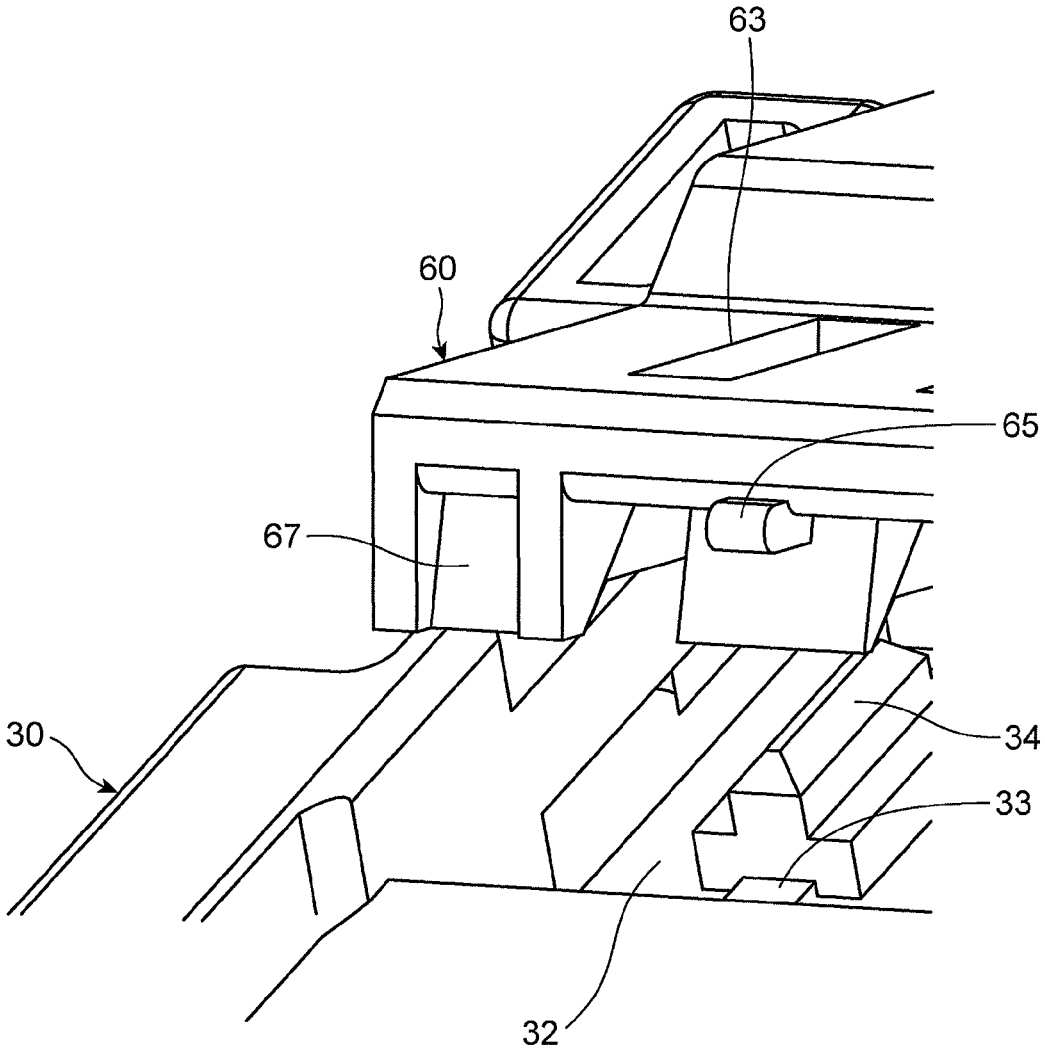
FIG. 13 is a perspective view of the electric connector illustrated in FIG. 1 which is being assembled, seen in an oblique and backward direction, with parts thereof being omitted.
Figure 14:
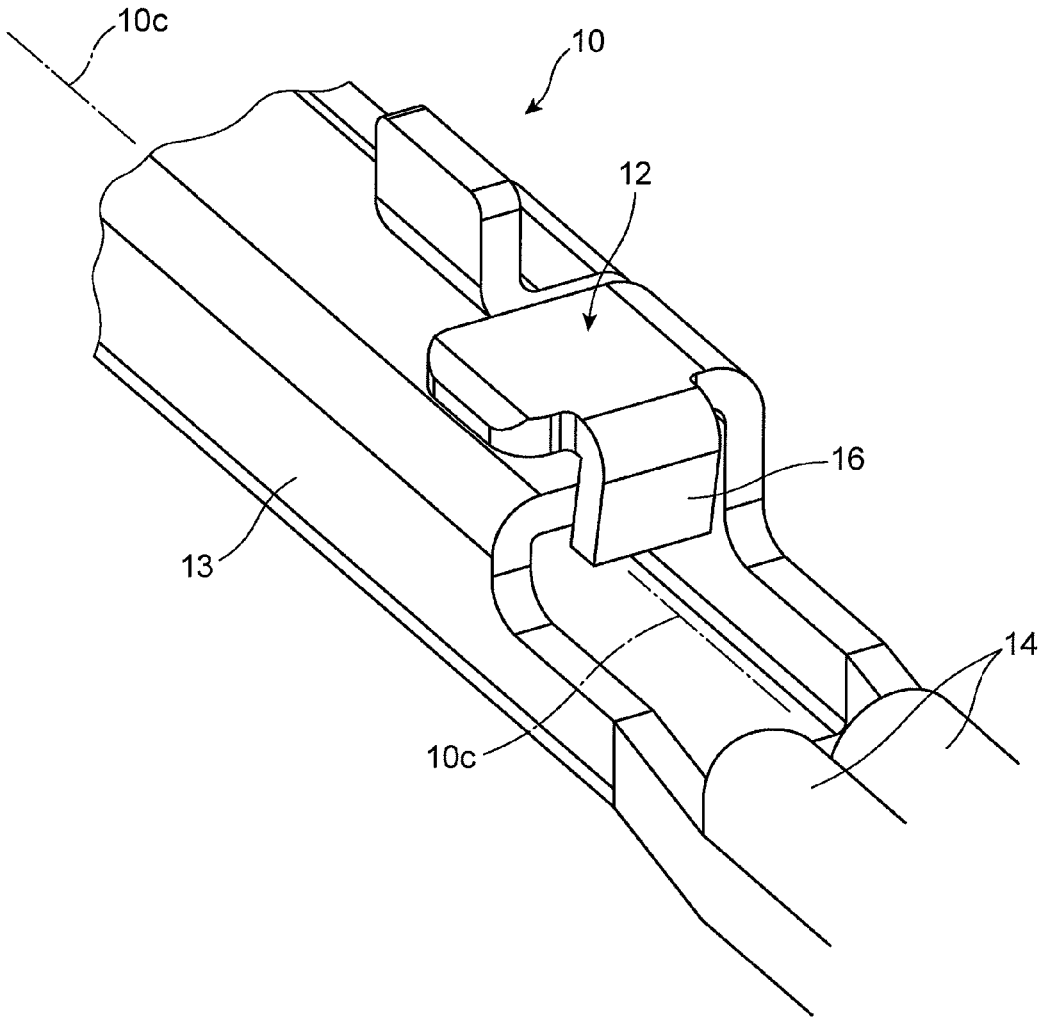
FIG. 14 is a perspective view of an area indicated with the arrow Y shown in FIG. 4, with parts of the electric connector being omitted.

As illustrated in FIGS. 13 and 14, the rear holder 60 is formed at a front thereof with the step-shaped recess 67 into which the downwardly extending tongue-shaped projection 16 formed at a rear of the second engagement section 12 of the terminal 10 is fit. Accordingly, when an external force (a tensile force) exerts on the terminal 10 in a direction opposite to the direction in which the terminal 10 is inserted into the groove 32, and thus, a rear of the second engagement section 12 of the terminal 10 makes contact with a front of the rear holder 60, the projection 16 of the second engagement section 12 of the terminal 10 is fit into the recess 67 of the rear holder 60. Thus, a broad area is ensured between the rear holder 60 and the housing 30, and a force for holding the terminal 10 in the housing 30 can be enhanced.

Furthermore, as illustrated in FIG. 15, since the surface 38*a* of the lock arm 38 is set substantially on a level S with the uppermost surface 39*a* of the lock guard 39, the electric connector 100 can be designed to have a reduced height. In addition, when a force (a force for elevating the surface 38*a*) exerts on the lock arm 38 for lifting the lock arm 38, and thus, the lock arm 38 is upwardly deformed, the lock arm 38 makes contact with a lower surface of the lock guard 39 set lower than the conventional connector, and thus, the lock arm 38 is prevented from being further deformed. Thus, it is possible to prevent the lock arm 38 from being deformed and/or broken. Furthermore, since the uppermost surface 39*a* of the lock guard 39 is set lower than the conventional connector, it is possible to reduce a wasteful gap to be formed between the electric connector 100 and the male housing 70, and a unit frame 80 and another unit 81 to be located thereabove.

The electric connector 100 having been described with reference to FIGS. 1 to 15 is just an example of the present invention, and the electric connector in accordance with the present invention is not to be limited to the above-mentioned electric connector 100.

INDUSTRIAL APPLICABILITY

The electric connector and the terminal in accordance with the present invention can be both employed broadly in various industrial fields such as electronic/electric device industry and automobile industry, as a device for electrically connecting a circuit board and a wire harness to each other.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. An electric connector including:

a housing including a groove into which a terminal is inserted, and a first engagement portion engageable to a first engagement section formed at said terminal;

a rear holder including a second engagement portion engageable to a second engagement section formed at said terminal, said rear holder being formed integrally with said housing such that said rear holder is rotatable at one end thereof relative to said housing; and a connector system for detachably fixing said housing and said rear holder to each other when said rear holder is rotated onto said housing, said connector system including a first projection formed at a partition wall defining said groove of said housing, and a first recess formed at said rear holder and configured to receive said first projection thereinto.

2. The electric connector as set forth in claim 1, wherein said rear holder forms an obtuse angle relative to said housing in a state in which the rear holder is in an open position.

3. The electric connector as set forth in claim 1, wherein said connector system includes a second projection formed at a side of said rear holder, and a second recess formed at said housing and configured to receive said second projection thereinto.

4. The electric connector as set forth in claim 3, wherein said second recess comprises an opening formed at a flexible upright wall of said housing such that said second projection is insertable into said opening.

5. The electric connector as set forth in claim 1, wherein said connector system includes a third projection formed at a front of said rear holder, and a third recess formed at said housing and configured to receive said third projection thereinto.

6. The electric connector as set forth in claim 1, further comprising a stopper formed at said first recess of said rear holder, said stopper being configured to make contact with said first projection to prevent said terminal from slipping out of said groove when an external force is exerted on said terminal in a direction opposite to a direction in which said terminal is inserted into said groove.

7. An electric connector including:

a housing including a groove into which a terminal is inserted;

a lock arm formed at said housing such that said lock arm is able to move substantially vertically relative to said housing in order to detachably engage to a male housing to which said housing is connected; and a lock guard configured to prevent said lock arm from being deformed in a direction in which said lock arm stands, said lock arm having a surface at which said lock arm is pushed, said surface being substantially on a level with an uppermost surface of said lock guard or lower than said uppermost surface of said lock guard, and said surface of said lock arm and said uppermost surface of said lock guard being aligned with each other in a direction in which said terminal is inserted into said groove.

8. An electric connector including:

a housing including a groove into which a terminal is inserted, and a first engagement portion engageable to a first engagement section formed at said terminal; and a rear holder including a second engagement portion engageable to a second engagement section formed at said terminal, said rear holder being formed integrally with said housing such that said rear holder is rotatable at one end thereof relative to said housing, said rear holder being formed at a front thereof with a recess into which a projection formed at a rear of said second engagement section of said terminal is fittable.

9. The electric connector as set forth in claim 8, wherein said rear holder forms an obtuse angle relative to said housing in a state in which the rear holder is in an open position.

10. A terminal adapted to be inserted into a groove formed at a housing, said housing being configured to cooperate with a rear holder to be connected to said housing to define an electric connector, said terminal including:

a first engagement section engageable to a first engagement portion of said housing; and a second engagement section engageable to a second engagement portion of said rear holder, said first engagement section having a projection projecting towards an axis of said terminal such that a ceiling of said terminal is configured to make contact with said projection when said ceiling is upwardly pushed by a second terminal inserted into said terminal.

11. The terminal as set forth in claim 10, wherein said second engagement section is formed at a rear thereof with a projection fittable into a recess formed at a front of said rear holder.

* * * * *